US009986321B1

(12) United States Patent
She

(10) Patent No.: US 9,986,321 B1
(45) Date of Patent: May 29, 2018

(54) SPEAKER MODULE

(71) Applicant: AAC Technologies Pte, Ltd., Singapore (SG)

(72) Inventor: Chunmei She, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days. days.

(21) Appl. No.: 15/677,064

(22) Filed: Aug. 15, 2017

(30) Foreign Application Priority Data

Mar. 3, 2017 (CN) ..... 2017 2 0202506 U

(51) Int. Cl.

| | |
|---|---|
| ***H04R 1/02*** | (2006.01) |
| ***H04R 9/06*** | (2006.01) |
| ***H04R 31/00*** | (2006.01) |
| ***H04R 1/28*** | (2006.01) |

(52) U.S. Cl.
CPC ..... *H04R 1/025* (2013.01); *H04R 1/2803* (2013.01); *H04R 31/00* (2013.01)

(58) Field of Classification Search
CPC ... H04R 7/06; H04R 7/16; H04R 7/18; H04R 9/06; H04R 9/025
USPC ..... 381/332, 334, 71.6, 87, 91, 398
See application file for complete search history.

(56) References Cited

U.S. PATENT DOCUMENTS

| | | | | |
|---|---|---|---|---|
| 9,781,846 | B2 * | 10/2017 | Sanford | H05K 5/0013 |
| 2010/0080400 | A1 * | 4/2010 | Sibbald | H04R 1/1083 381/71.6 |
| 2016/0345090 | A1 * | 11/2016 | Wilk | B01D 53/04 |

* cited by examiner

*Primary Examiner* — Thjuan K Addy
(74) *Attorney, Agent, or Firm* — Na Xu; IPro, PLLC

(57) ABSTRACT

The present invention provides a speaker module including a housing with an inner cavity. The housing includes a side wall and a sounding hole formed through the side wall. The speaker module further has a speaker unit mounted in the inner cavity; a cover plate arranged in the inner cavity for dividing the inner cavity into a front cavity communicating with the sounding hole and a back cavity opposite to the front cavity; and a case with a volume covering the cover plate and arranged in the back cavity. The cover plate is provided with a through hole communicating the front cavity with the volume.

5 Claims, 3 Drawing Sheets

SPEAKER MODULE

CROSS-REFERENCE TO RELATED APPLICATIONS

This application claims the priority benefit of Chinese Patent Application Ser. No. 201720202506.X filed on Mar. 3, 2017, the entire content of which is incorporated herein by reference.

FIELD OF THE PRESENT DISCLOSURE

The present disclosure relates to the field of electroacoustic transducers, more particularly to a speaker module including a speaker unit.

DESCRIPTION OF RELATED ART

A related speaker module comprises a housing with an inner cavity and a speaker unit mounted in the inner cavity. And the housing comprises a side wall and a sounding hole formed through the side wall, and the speaker unit comprises a diaphragm used for a vibration sounding, and the speaker module also comprises a cover plate arranged in the inner cavity. The cover plate and the diaphragm jointly divide the inner cavity into a front cavity and a back cavity arranged opposite to the front cavity, and the front cavity communicates with the sounding hole. During the process a sound wave is spreading outwards from the front cavity, there is a very high resonant peak being generated in a medium frequency of a frequency sound caused by the resonance of the front cavity, and the too high resonant peak is more jarring at the resonant frequency of the front cavity, with higher distortion.

Therefore it is necessary to provide an improved speaker module for overcoming the above-mentioned disadvantages.

BRIEF DESCRIPTION OF THE DRAWING

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
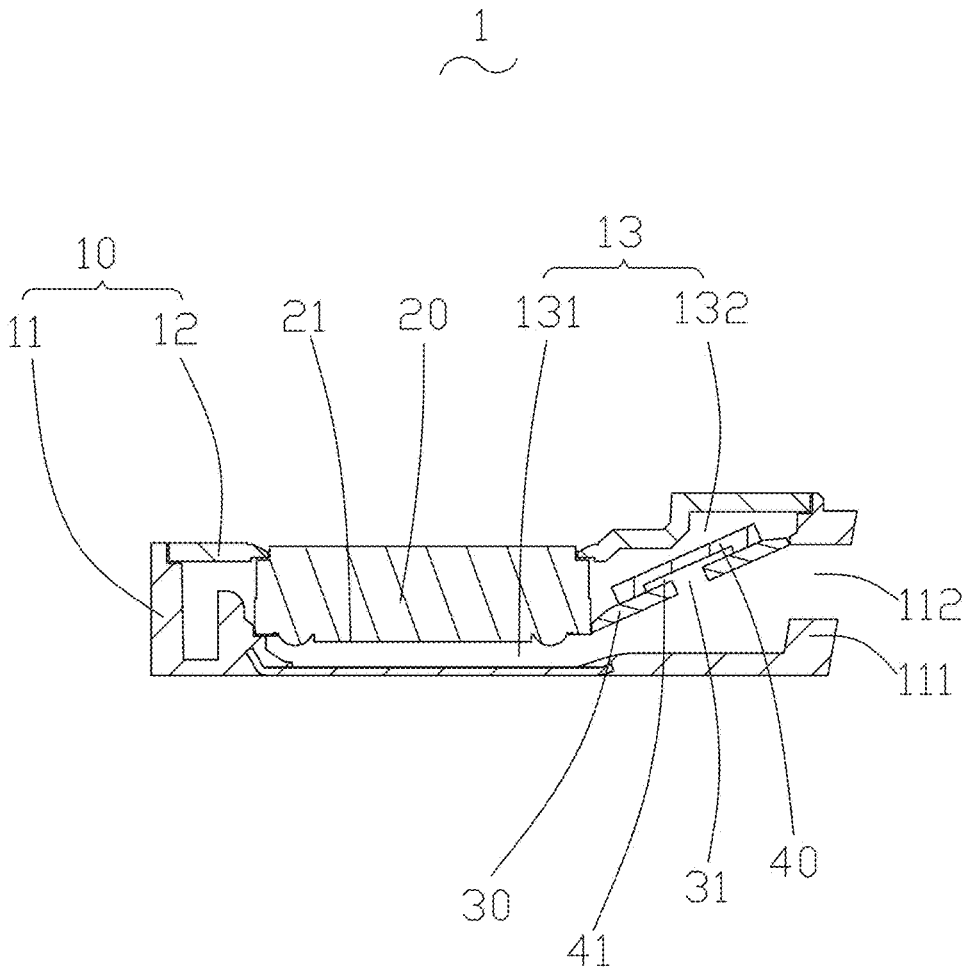
FIG. 1 is a cross-sectional view of a speaker module in accordance with an exemplary embodiment of the present disclosure.
Figure 2:
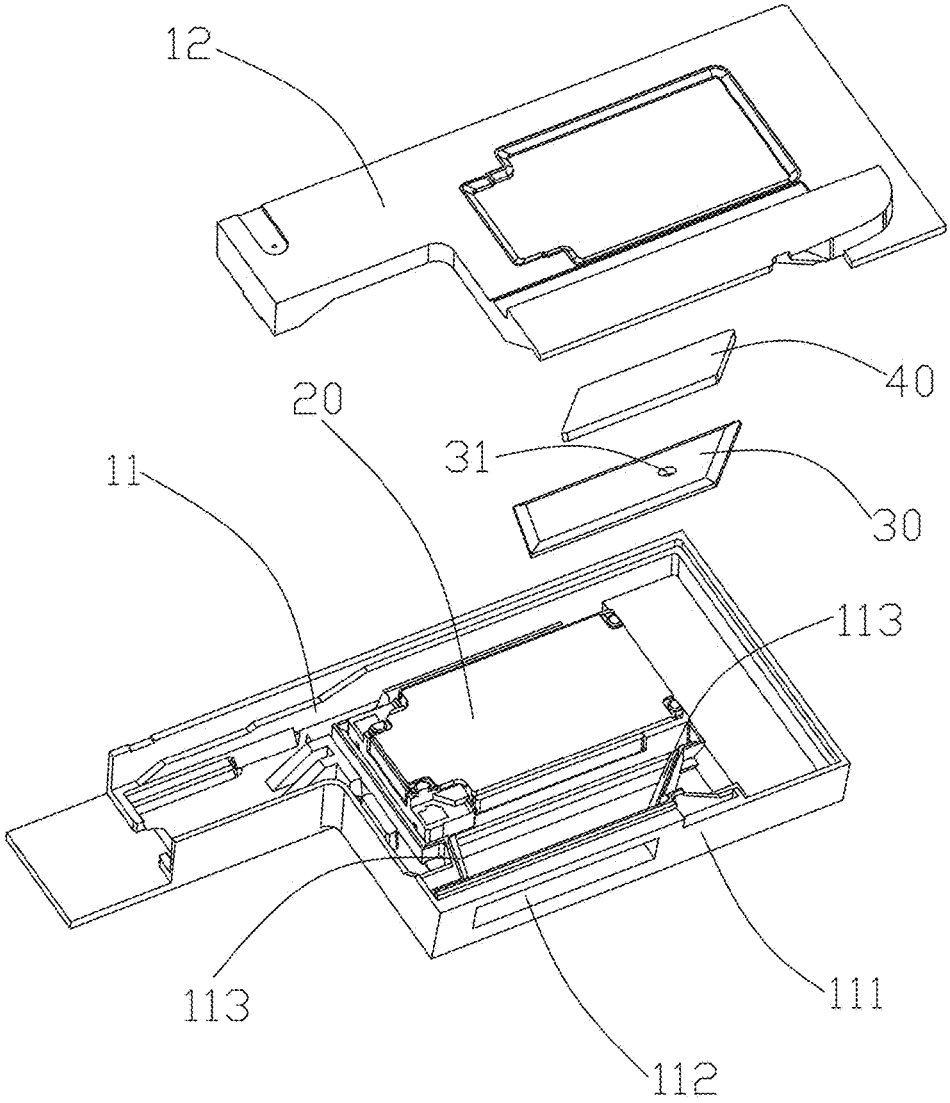
FIG. 2 is an exploded view of the speaker module in FIG. 1.
Figure 3:
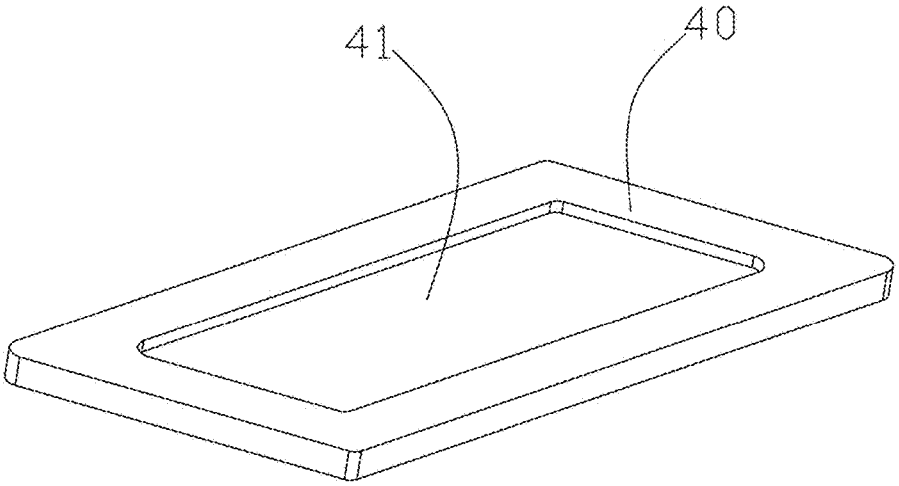
FIG. 3 is an isometric view of a case of the speaker module in FIG. 1.

As shown in FIGS. 1-3, a speaker module 1 provided by the present disclosure comprises a housing 10. The housing 10 comprises a lower cover 11 and an upper cover 12 connecting to the lower cover 11, and the lower cover 11 and the upper cover 12 jointly enclose an inner cavity 13 of the housing 10.

The speaker module 1 further comprises a speaker unit 20 mounted in the inner cavity 13. The speaker unit 20 comprises a diaphragm 21 used for generating sound. The housing 10 comprises a side wall 111 and a sounding hole 112 formed through the side wall 111.

The speaker module 1 further comprises a cover plate 30 arranged in the inner cavity 13, and the cover plate 30 and the diaphragm 21 jointly divide the inner cavity 13 into a front cavity 131 and a back cavity 132 arranged opposite to the front cavity 131, and the front cavity 131 communicates with the sounding hole 112.

The housing 10 further comprises a support bar 113 connecting the speaker unit 20 and the side wall 111, and the cover plate 30 covers and connects to the support bar 113. Optionally, the cover plate 30 is fixed to the support bar 113 by ultrasonic welding. A seal is formed by a seal glue around the cover plate 30, in order to guarantee that the front cavity 131 will never leak any gas.

In the speaker module 1, a case 40 with a volume 41 covering the cover plate 30 is arranged in the back cavity 132, and the cover plate 30 is arranged with a through hole 31 communicating the front cavity 131 with volume 41.

A resonant frequency of the volume 41 is adjusted by controlling the sizes of the volume 41 and the through hole 31, in order to make the resonant frequency of the volume 41 and the resonant frequency of the front cavity of the speaker module 1 consistent. During the process a sound wave is spreading outwards from the front cavity 131, the volume 41 plays a role of a filter, which reduces a resonant peak and improves a distortion of the speaker module 1.

In this embodiment, the resonant frequency of the volume 41 is set as 1 k~2 kHz, in order to eliminate the resonant frequency of the front cavity of the speaker module 1 in the medium frequency sounding field, and improve the distortion of the speaker module 1 in the medium frequency sounding field.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker module, including a housing with an inner cavity, the housing comprising a side wall and a sounding hole formed through the side wall;

a speaker unit mounted in the inner cavity, the speaker unit including a diaphragm for generating sound;

a cover plate arranged in the inner cavity for dividing the inner cavity into a front cavity communicating with the sounding hole and a back cavity opposite to the front cavity cooperatively with the diaphragm;

a case with a volume covering the cover plate and arranged in the back cavity; wherein the cover plate is provided with a through hole communicating the front cavity with the volume.

2. The speaker module as described in claim 1, wherein a resonant frequency of the volume is 1 k~2 kHz.

3. The speaker module as described in claim 1, wherein the housing further comprises a support bar connecting the speaker unit to the side wall, and the cover plate connects to the support bar.

4. The speaker module as described in claim 3, wherein the cover plate is fixed to the support bar by ultrasonic welding.

5. The speaker module as described in claim 3, wherein a seal is formed by a seal glue around the cover plate.

* * * * *